US008819944B2

(12) United States Patent
Farland et al.

(10) Patent No.: US 8,819,944 B2
(45) Date of Patent: Sep. 2, 2014

(54) BLADED TOOL WITH A BENT BLADE-RETAINING SHANK

(75) Inventors: Richard M. Farland, Sturbridge, MA (US); John Li kaijun, Guangzhou (CN); Corey Talbot, Hebron, CT (US)

(73) Assignee: Hyde Tools, Inc., Southbridge, MA (US)

( * ) Notice: Subject to any disclaimer, the term of this patent is extended or adjusted under 35 U.S.C. 154(b) by 419 days.

(21) Appl. No.: 13/134,338

(22) Filed: Jun. 6, 2011

(65) Prior Publication Data

US 2012/0036668 A1 Feb. 16, 2012

Related U.S. Application Data

(60) Provisional application No. 61/397,107, filed on Jun. 7, 2010.

(51) Int. Cl.
*B25G 3/00* (2006.01)
*B25G 3/28* (2006.01)

(52) U.S. Cl.
CPC ..... *B25G 3/28* (2013.01)
USPC ..... 30/169; 30/162; 15/245.1

(58) Field of Classification Search
USPC ..... 15/236.1, 245.1; 30/169, 342, 335–339
IPC ..... B05C 17/10; E04F 21/32
See application file for complete search history.

(56) References Cited

U.S. PATENT DOCUMENTS

| | | | | |
|---|---|---|---|---|
| 565,910 | A | 8/1896 | Maynard | |
| 3,683,496 | A | 8/1972 | Johnson | |
| 4,794,694 | A * | 1/1989 | Daniel et al. | 30/169 |
| 2005/0193566 | A1 * | 9/2005 | Brown et al. | 30/162 |
| 2009/0165311 | A1 | 7/2009 | Patel et al. | |

FOREIGN PATENT DOCUMENTS

| | | | |
|---|---|---|---|
| GB | 405782 | A | 2/1934 |

* cited by examiner

*Primary Examiner* — Monica Carter
*Assistant Examiner* — Stephanie Berry
(74) *Attorney, Agent, or Firm* — Louis J. Franco; Law Office of Louis J. Franco

(57) ABSTRACT

A bladed tool includes a handle and a blade with a surface-engaging edge and a blade-retaining shank. The handle includes an elongated handle body having longitudinally opposed body front and rear ends, and at least one side wall extending between the body front and rear ends. The side wall defines an outer surface configured for gripping by a user and an inner surface that defines an interior access channel extending from an access opening in the body rear end toward a forward channel wall located to the rear of the body front end. Situated between the body front end and the forward channel wall is a handle core that defines a shank-retaining slot extending between a forward slot-opening in the body front end and a rearward slot-opening in the forward channel wall. The shank extends rearwardly through the shank-retaining slot such that a protruding shank portion extends to the rear of the forward channel wall. Forward movement of the shank relative to the handle body is prevented by bending the shank rearward of the forward channel wall.

12 Claims, 3 Drawing Sheets

BLADED TOOL WITH A BENT BLADE-RETAINING SHANK

PROVISIONAL PRIORITY CLAIM

Priority based on Provisional Application Ser. No. 61/397,107 filed Jun. 7, 2010, and entitled "BLADED TOOL WITH A BENT BLADE-RETAINING SHANK" is claimed. Moreover, the entirety of the previous provisional application, including the drawings, is incorporated herein by reference as if set forth fully in the present application.

BACKGROUND

Although not so limited in utility or scope, embodiments of the present invention relate to bladed drywall tools such as taping knives and putty knives. A traditional taping knife includes a flat, planar blade with a surface-engaging edge. Extending from the rear of the blade, and integral therewith, is a shank having upper and lower shank surfaces. Attached to the upper and lower shank surfaces, and coextensive with at least a majority portion thereof, are, respectively, upper and lower handle portions such that the shank is "sandwiched" therebetween. The handle portions are retained to the shank by one or more of (i) curable adhesive such as epoxy and (ii) fasteners such as rivets or screws.

In addition to taping knives constructed as generally described above, there exist taping knives with solid-core plastic handles, some of which include overmolds made from material of lower durometer to provide a comfortable and relatively high-friction gripping surface. In such a taping knife, the core includes a core slot extending longitudinally from an opening in a front end of the solid core toward—and typically almost to—a rear core end opposite the front core end. The shank includes protuberances (e.g., sawtooth-shaped ridges or forwardly-directed barbs) such that, after the shank is forcibly inserted into the core slot through the opening during fabrication, it is prevented by the core material's engagement with the protuberances from being readily removed from the handle.

In accordance with either of the traditional configurations described above, the metal shank extending rearwardly of the blade is invariably nearly the entire length of the handle, whether it be sandwiched between upper and lower handle portions with its edge visible therebetween or encased in a polymeric (e.g., plastic) core. Moreover, in the latter type in which the shank is encased in a polymeric material, the polymeric core is typically "solid" or "contiguous" throughout and includes few in any voids.

Accordingly, there exists a need for a bladed tool configured in a manner that substantially reduces that amount of metal (e.g., steel) required in the blade-retaining shank and, relative to various existing configurations, the amount of polymeric material (e.g., plastic) dedicated to the shank-encasing handle core.

SUMMARY

In each of various alternative embodiments, a bladed tool includes a blade and a handle that retains the blade. Although bladed tools within the scope and contemplation of the present invention may be of various alternative forms, various versions are alternatively embodied as surface-preparation tools with surface-preparation blades such as, by way of non-limiting example, taping knives and putty knives. The blade has a surface-engaging edge and a blade-retaining shank extending rearwardly of the surface-engaging edge.

The handle includes an elongated handle body with longitudinally opposed body front and rear ends and at least one side wall extending between the body front and rear ends. The at least one side wall has an outer surface configured for gripping by a user and an inner surface that defines an interior access channel extending from the body rear end toward a forward channel wall located to the rear of the body front end.

In order to retain the blade, the handle body further includes a handle core extending between the body front end and the forward channel wall. The handle core defines a shank-retaining slot extending between a forward slot-opening in the body front end and a rearward slot-opening in the front channel wall. The shank extends rearwardly through the shank-retaining slot such that a protruding shank portion extends to the rear of the forward channel wall. Forward movement of the shank relative to the handle body is prevented at least in part by a bend formed in the shank such that the protruding shank portion is misaligned relative to a remainder of the shank and cannot pass through the shank-retaining slot.

Various embodiments of a bladed tool are configured so as to minimize, or at least reduce, the amount of blade (i.e., shank) and handle material required, thereby reducing weight for the user and cost to the manufacturer. Accordingly, in various versions, the body front end is more proximate the forward channel wall than is the body rear end. In other words, in various configurations, the hollow interior access channel is longer than the handle core, the latter being mostly "solid" or "continuous" in various embodiments.

In various alternative versions, the blade-retaining shank comprises first and second shank tangs that are mutually laterally separated by a tang gap. Each tang has an inner tang edge defining a portion of the tang gap and an outer tang edge laterally opposite the inner tang edge. In alternatively configured embodiments including first and second shank tangs, the shank-retaining slot is bifurcated by a wedged bulkhead that increases in width toward the rearward slot-opening such that, when the tangs are forcibly inserted into the shank-retaining slot during fabrication of the bladed tool, the wedged bulkhead is driven into the tang gap between the first and second tangs in a manner tending to laterally separate the tangs. In versions in which the shank is defined by a plurality (i.e., at least two) tangs, a protruding tang portion of at least one of the tangs extends to the rear of the forward channel wall and constitutes the protruding shank portion.

Representative embodiments are more completely described and depicted in the following detailed description and the accompanying drawings.

DETAILED DESCRIPTION

The following description of variously embodied bladed tools is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
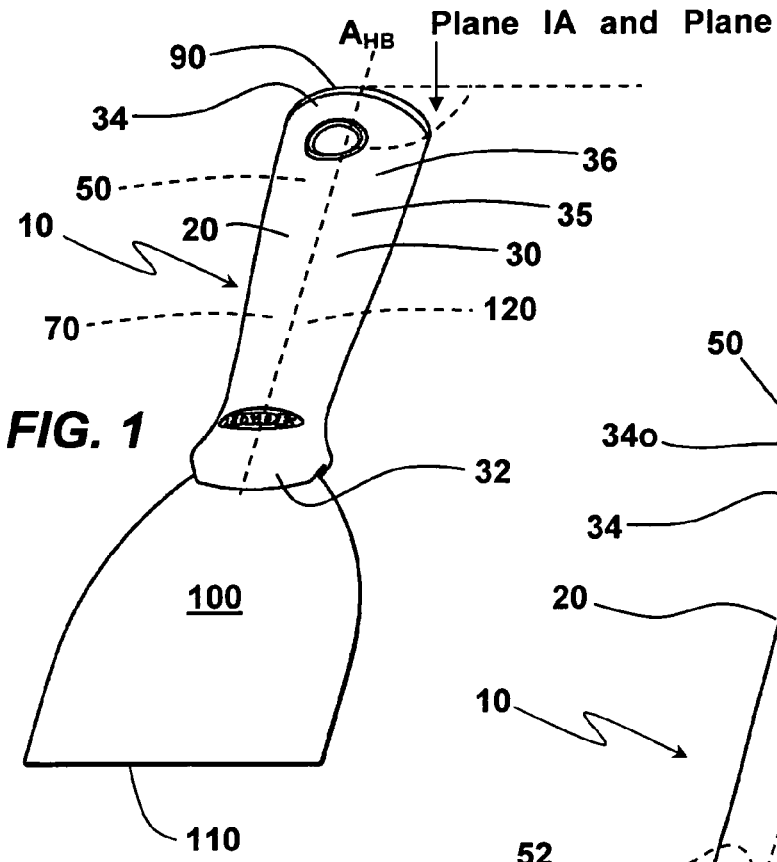
FIG. 1 is a top perspective view of a bladed tool.
Figure 2:
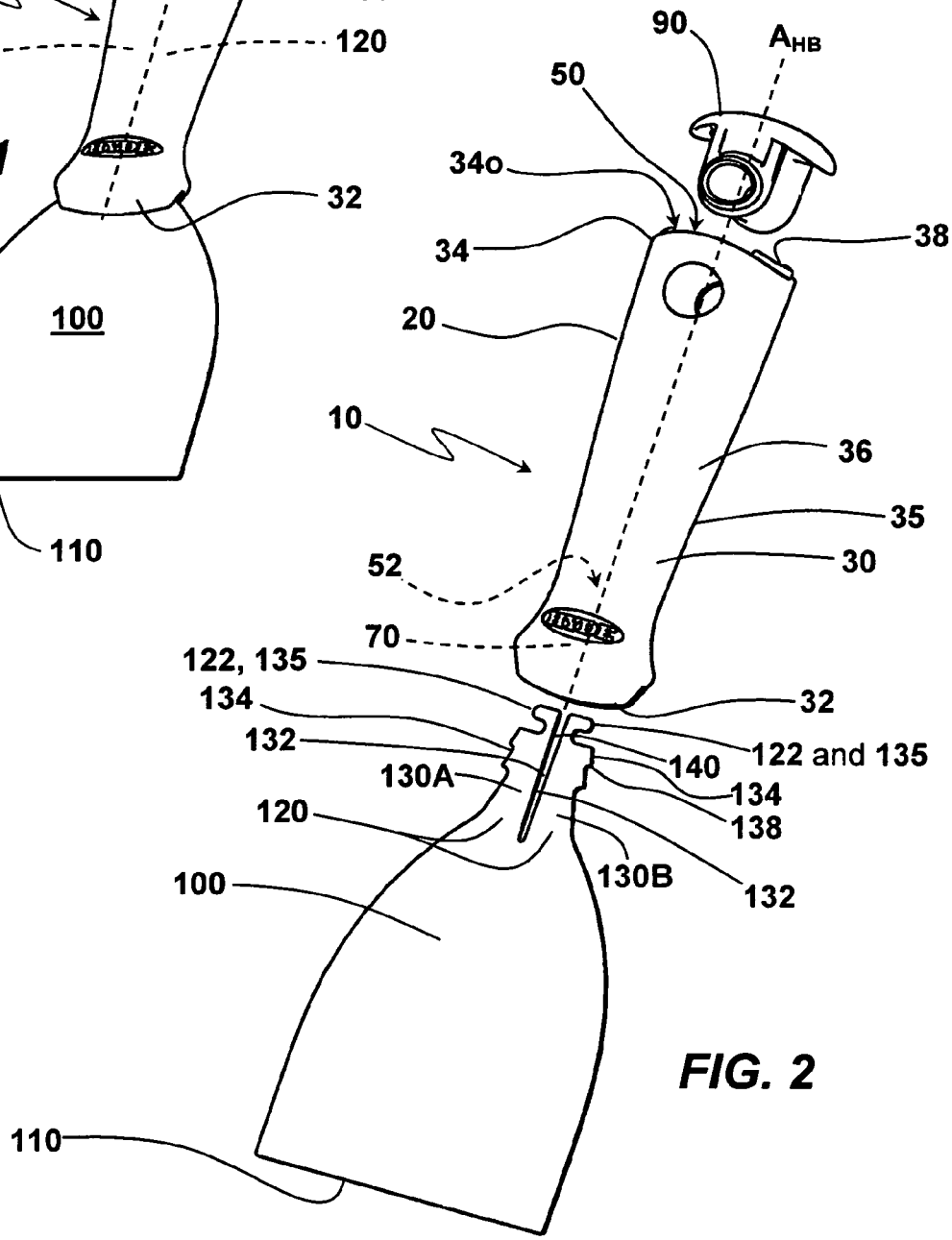
FIG. 2 is an exploded view of the bladed tool of FIG. 1.

With initial reference to FIG. 1, and the exploded view of FIG. 2, an illustrative embodiment of a bladed tool 10 includes an elongated handle 20 and a blade 100 fixedly retained by, and depending forwardly of, the handle 20. The blade 100 has a surface-engaging blade edge 110 and a blade shank 120 that extends rearwardly of the surface-engaging edge 110. The handle 20 comprises an elongated handle body 30 that extends longitudinally along a handle-body axis $A_{HB}$ between opposed handle-body front and rear ends 32 and 34. At least one side wall 35 defines a handle outer surface 36 that extends between the front and rear ends 32 and 34 and is configured for gripping by a user.

Figure 1A:
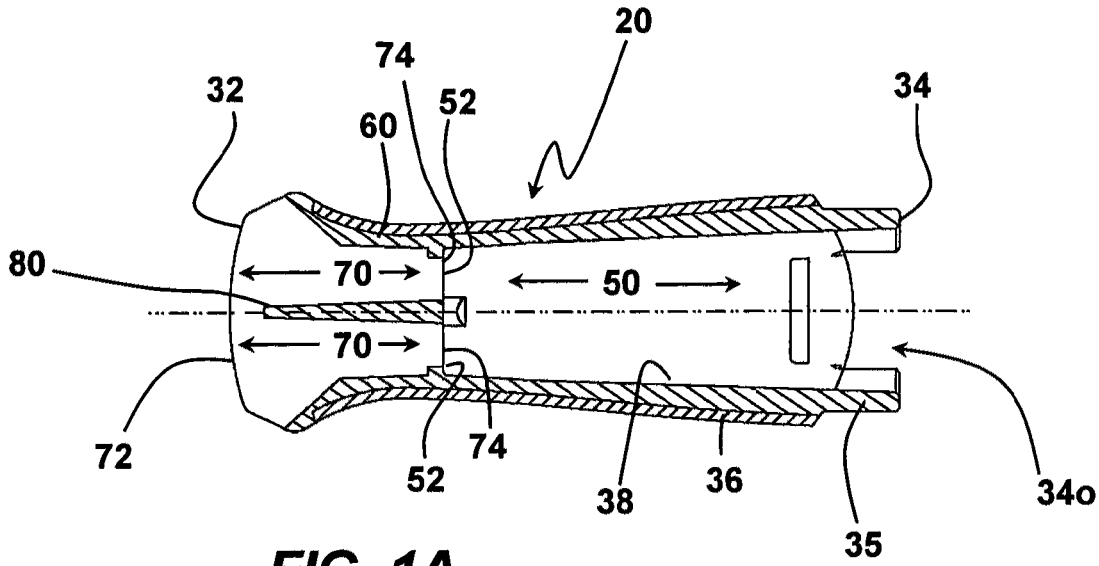
FIG. 1A is a cross-section of the handle of the bladed tool of FIG. 1 as viewed into the plane IA shown in FIG. 1.
Figure 2A:
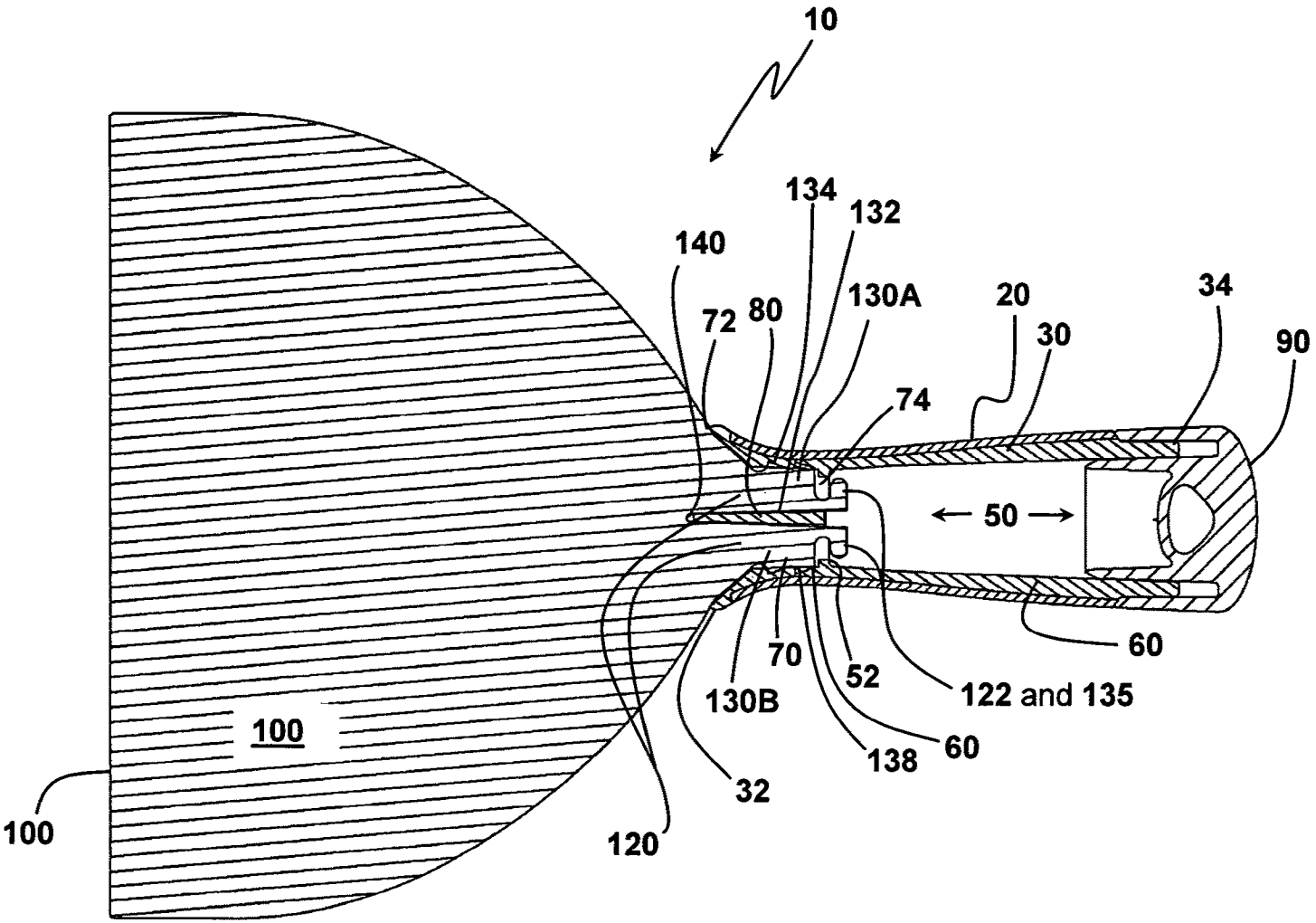
FIG. 2A is a cross-sectional view of the bladed tool in FIG. 1 as viewed into the plane IIA shown in FIG. 1.

As shown in FIG. 1A, which is a cross-section of the handle 20 as viewed into the plane IA of FIG. 1, and FIG. 2A, which is a cross-section of the bladed tool 10 as viewed into the plane IIA of FIG. 1, the side wall 35 of the handle 20 further includes an inner surface 38 that defines an interior access channel 50. The access channel 50 extends from the handle-body rear end 34 toward a forward channel wall 52 located to the rear of the handle-body front end 32. A shank-supporting handle core 60 extends between the handle-body front end 32 and the forward channel wall 52. The handle core 60 defines a shank-retaining slot 70 extending between a forward slot-opening 72 in the handle-body front end 32 and a rearward slot-opening 74 in the forward channel wall 52.

Figure 3:
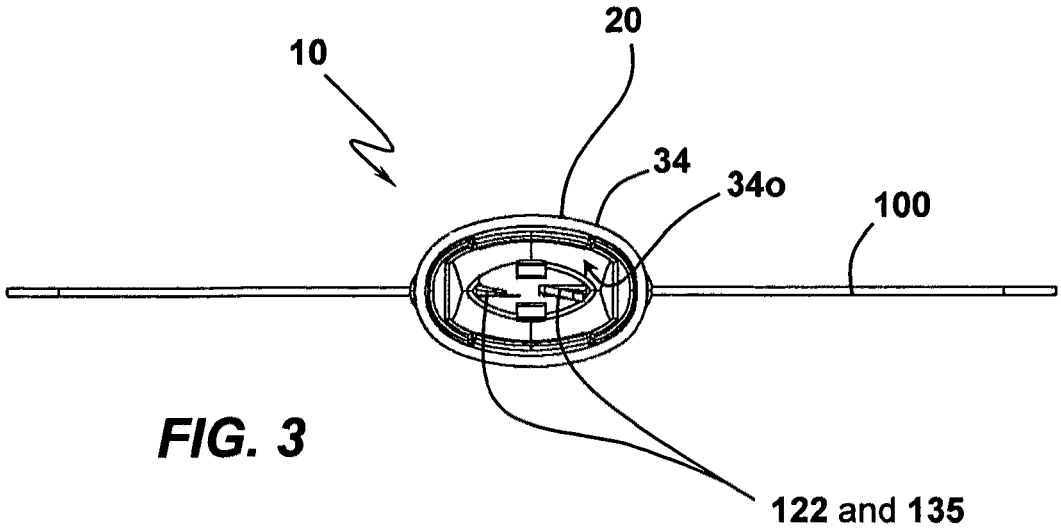
FIG. 3 is a rear end view into the access opening of the bladed tool of FIGS. 1 and 2.

With continued reference to FIGS. 2 and 2A, in assembling the bladed tool 10, the blade shank 120 is forcibly introduced into the shank-retaining slot 70 through the forward slot-opening 72 and driven rearward toward the handle-body rear end 34. The shank 120 is of sufficient length such that, with the shank 120 driven into the shank-retaining slot 70 to the desired depth, a protruding shank portion 122 extends to the rear of the forward channel wall 52. With the shank 120 seated as desired within the shank-retaining slot 70, a bend is formed in the shank 120 by introducing a bending tool (not shown) through an access opening 34*o* in the handle-body rear end 34 and bending the protruding shank portion 122 such that the protruding shank portion 122 is misaligned relative to a remainder of the shank 120 and cannot pass forwardly through the shank-retaining slot 70. The misalignment of each of two protruding shank portions 122 is shown in the rear view of FIG. 3 through the access opening 34*o*.

It is to be understood that embodiments within the scope and contemplation of the invention are alternatively configured. With specific reference to FIGS. 1A, 2, and 2A, the blade shank 120 includes first and second shank tangs 130A and 130B. For purposes of convenience and clarity, like portions of the tangs 130A and 130B are referenced by like reference characters, while the tangs 130A and 130B are distinguished from one another only by the inclusion of the letters A and B in the reference characters associated with, respectively, the first and second tangs 130A and 130B. In referring to the tangs 130A and 130B collectively, the distinguishing letter portions may be omitted. The shank tangs 130 are laterally separated (i.e., mutually spaced) by a tang gap 140. Each of the first and second tangs 130A and 130B has an inner tang edge 132 defining a portion of the tang gap 140 and an outer tang edge 134 laterally opposite, and to the outside of, the inner tang edge 132.

As shown in the cross-sectional views of FIGS. 1A and 2A, the shank-retaining slot 70 is at least partially bifurcated by a wedged bulkhead 80 that increases in lateral thickness (i.e., width) toward the rearward slot-opening 74 such that, when the tangs 130A and 130B are forcibly inserted into the shank-retaining slot 70 during fabrication of the bladed tool 10, the wedged bulkhead 80 is driven into the tang gap 140 in a manner tending to laterally separate the tangs 130A and 130B. In the illustrative embodiment depicted, a protruding tang portion 135 of each of the first and second tangs 130A and 130B extends to the rear of the forward channel wall 52 and constitutes a protruding shank portion 122. However, it is to be understood that versions including a plurality (at least two) tangs 130 may be alternatively configured such at that fewer than all of the tangs 130 are sufficiently long to include a protruding tang portion 135.

While the bending of at least one protruding shank portion 122 such as a protruding tang portion 135 contributes substantially to the retention of the shank 120 within the handle 20, in various versions, additional structures are included, and measures taken, in order to contribute to blade retention. For instance, with reference to FIGS. 2 and 2A, the outer tang edge 134 of each of tangs 130A and 130B includes rigid protuberances 138 that form an interference fit with the handle core 60 defining the shank-retaining slot 70. The interference fit is substantially enhanced by the tang-spreading force applied by the wedged bulkhead 80. Alternative versions include an adhesive (not shown) such as epoxy to add bladed-retaining strength.

Subsequent to the insertion of the blade shank 120 into the blade-retaining slot 70, and the bending of at least one protruding shank portion 122, the access opening 34*o* in the handle-body rear end 34 is, in various versions, closed off with a handle cap 90. In alternative versions, the handle cap 90 is removably retained by the handle 20. Illustrative handle caps 90 are shown in FIGS. 1, 2 and 2A. The foregoing is considered to be illustrative of the principles of the invention.

Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A bladed tool comprising:

a blade including a surface-engaging edge and a blade-retaining shank extending rearwardly of the surface-engaging edge; and a handle comprising (i) an elongated handle body having longitudinally opposed body front and rear ends, (ii) at least one side wall extending between the body front and rear ends and including an outer surface configured for gripping by a user and an inner surface that defines an interior access channel extending from the body rear end toward a forward channel wall located to the rear of the body front end, and (iii) a handle core extending between the body front end and the forward channel wall and defining a shank-retaining slot extending between a forward slot-opening in the body front end and a rearward slot-opening in the forward channel wall; wherein (a) the shank extends rearwardly through the shank-retaining slot such that a protruding shank portion extends to the rear of the forward channel wall and forward movement of the shank relative to the handle body is prevented at least in part by a bend formed in the shank such that the protruding shank portion is misaligned relative to a remainder of the shank and cannot pass through the shank-retaining slot:

(b) the shank comprises first and second shank tangs laterally separated by a tang gap, each tang having an inner tang edge defining a portion of the tang gap and an outer tang edge laterally opposite the inner tang edge;

(c) the shank-retaining slot is bifurcated by a wedged bulkhead that increases in width toward the rearward slot-opening such that, when the tangs are forcibly inserted into the shank-retaining slot during fabrication of the bladed tool, the wedged bulkhead is driven into the tang gap between the first and second tangs in a manner tending to laterally separate the tangs; and (d) a protruding tang portion of at least one of the tangs extends to the rear of the forward channel wall and constitutes the protruding shank portion.

2. The bladed tool of claim 1 wherein the body front end is more proximate the forward channel wall than is the body rear end.

3. The bladed tool of claim 2 wherein the blade is a surface-preparation blade.

4. The bladed tool of claim 1 wherein the blade is a surface-preparation blade.

5. The bladed tool of claim 1 wherein the outer tang edge of at least one of the first and second shank tangs includes rigid protuberances that form an interference fit with the core defining the shank-retaining slot.

6. The bladed tool of claim 5 wherein the body front end is more proximate the forward channel wall than is the body rear end.

7. A method of fabricating a bladed tool comprising:

providing a blade including a surface-engaging edge and a blade-retaining shank extending rearwardly of the surface-engaging edge;

providing a handle comprising (i) an elongated handle body having longitudinally opposed handle-body front and rear ends, (ii) at least one side wall extending between the handle-body front and rear ends and including an outer surface configured for gripping by a user and an inner surface that defines an interior access channel extending from an access opening in the handle-body rear end toward a forward channel wall located to the rear of the handle-body front end, and (iii) a handle core extending between the handle-body front end and the forward channel wall and defining a shank-retaining slot extending between a forward slot-opening in the handle-body front end and a rearward slot-opening in the forward channel wall;

driving the blade-retaining shank into the shank-retaining slot through the forward slot-opening such that the shank extends rearwardly through the shank-retaining slot and a protruding shank portion extends to the rear of the forward channel wall; and bending the protruding shank portion extending to the rear of the forward channel wall such that the protruding shank portion is misaligned relative to a remainder of the blade-retaining shank in order to prevent forward movement of the blade-retaining shank relative to the handle body; wherein the bending of the protruding shank portion is facilitated by a bending tool introduced through the access opening in the handle-body rear end.

8. The method of claim 7 wherein (a) the blade-retaining shank comprises first and second shank tangs laterally separated by a tang gap, each tang having an inner tang edge defining a portion of the tang gap and an outer tang edge laterally opposite the inner tang edge;

(b) the shank-retaining slot is bifurcated by a wedged bulkhead that increases in width toward the rearward slot-opening such that, when the blade-retaining shank is driven into the shank-retaining, the wedged bulkhead is driven into the tang gap in a manner tending to laterally separate the tangs; and (c) a protruding tang portion of at least one of the tangs extends to the rear of the forward channel wall and constitutes the protruding shank portion.

9. The method of claim 8 wherein the outer tang edge of at least one of the first and second shank tangs includes rigid protuberances that form an interference fit with the core defining the shank-retaining slot.

10. The method of claim 7 further comprising closing with a handle cap the access opening in the handle-body rear end subsequent to bending the protruding shank portion.

11. A bladed tool comprising;

a blade including a surface-engaging edge and a blade-retaining shank extending rearwardly of the surface-engaging edge; and a handle comprising (i) an elongated handle body having longitudinally opposed handle-body front and rear ends, (ii) at least one side wall extending between the handle-body front and rear ends and including an inner surface that defines an interior access channel extending from the handle-body rear end toward a forward channel wall located to the rear of the handle-body front end, and (iii) a handle core extending between the handle-body front end and the forward channel wall and defining a shank-retaining slot extending between a forward slot-opening in the handle-body front end and a rearward slot-opening in the forward channel wall; wherein (a) the shank extends rearwardly through the shank-retaining slot such that a protruding shank portion extends to the rear of the forward channel wall;

(b) forward movement of the shank relative to the handle body is prevented at least in part by a bend formed in the shank such that the protruding shank portion is misaligned relative to a remainder of the shank and cannot pass through the shank-retaining slot;

(c) the handle-body rear end includes an access opening; and (d) the bend is formed by a bending tool introduced into the access channel through the access opening.

12. The bladed tool of claim 11 further comprising a handle cap closing off the access opening.

* * * * *